US005441602A

United States Patent [19]

Harris et al.

[11] Patent Number: 5,441,602

[45] Date of Patent: Aug. 15, 1995

[54] PROCESS FOR THE PREVENTION OF SCALE FORMATION IN WOOD PULP PRODUCTION

[75] Inventors: Arthur Harris; John Burrows, both of Cheshire; David Wilson, Manchester, all of England

[73] Assignee: FMC Corporation, Philadelphia, Pa.

[21] Appl. No.: 108,844

[22] Filed: Aug. 18, 1993

Related U.S. Application Data

[63] Continuation of Ser. No. 448,785, Dec. 11, 1989, abandoned.

[30] Foreign Application Priority Data

Dec. 21, 1988 [GB] United Kingdom ..... 8829829

[51] Int. Cl.[6] ..... D21C 3/20

[52] U.S. Cl. ..... 162/48; 162/72; 162/199; 162/DIG. 4

[58] Field of Search ..... 162/48, 72, 199, DIG. 4

[56] References Cited

U.S. PATENT DOCUMENTS

| | | | |
|---|---|---|---|
| 3,929,635 | 12/1975 | Buriks et al. | 210/734 |
| 4,049,546 | 9/1977 | Rock | 162/30.11 X |
| 4,126,549 | 11/1978 | Jones et al. | 210/58 |

FOREIGN PATENT DOCUMENTS

| | | |
|---|---|---|
| 212681 | 7/1985 | Japan . |
| 140582 | 4/1986 | Japan . |
| 1113644 | 5/1968 | United Kingdom . |

OTHER PUBLICATIONS

Derwent 85-212681/35 (Abstract).
Derwent 86-140582/22 (Abstract).

*Primary Examiner*—Thi Dang
*Attorney, Agent, or Firm*—Patrick C. Baker; Robert L. Andersen; Charles C. Fellows

[57] ABSTRACT

Hydrolyzed copolymers of (A) maleic anhydride with (B) at least one mono-ethylenically unsaturated monomer other than acrylic acid or methacrylic acid or with a mixture of (B) and (C) acrylic acid or methacrylic acid are effective for inhibiting the formation of calcium carbonate scale in wood pulp production.

23 Claims, No Drawings

PROCESS FOR THE PREVENTION OF SCALE FORMATION IN WOOD PULP PRODUCTION

This application is a continuation of application Ser. No. 07/448,785, filed Dec. 11, 1989, now abandoned.

The present invention relates to the prevention of scale formation during wood pulp production.

Wood pulp is the basic raw material used in the manufacture of all grades of paper and various types of packaging drums and cartons.

In order to produce pulp from wood, it is necessary to separate the cellulose fibres from the various organic compounds, mainly lignin, which bind them together. Various mechanical, mechanical/chemical and chemical methods are used to effect this separation, but the most widely used technique is known as the Kraft or sulphate process, since it produces pulp which gives high strength and good aging properties to paper products.

In the Kraft process, a cooking liquor (white liquor) of sodium hydroxide and sodium sulphide is used to extract the lignin from wood. The process of extraction is carded out in digesters, either batch or continuous. The pH in the digester is between 12 and 14.

The liquor temperature is maintained between 150°–175° C., and a period of 1 to 2 hours is required for complete digestion. The pulp is then washed before being sent for further treatment such as bleaching prior to its further use.

The economics of the Kraft process depend on the recovery of the cooking liquor. In this recovery process, the digestion chemicals contained in the used cooking liquor (black liquor) are recovered via evaporators, furnace and causticiser for re-use in preparing new "whim" cooking liquor.

The cooking liquor (white liquor) produced from this process contains sodium hydroxide, sodium sulphide, and sodium carbonate due to incomplete reactions in the causticiser, as well as soluble calcium and precipitated calcium carbonate.

In the Kraft process, calcium is extracted from the wood, and because of the high pH, temperature and presence of carbonate in the cooking liquor this calcium precipitates as calcium carbonate. The most visible form of the scale is in the cooking liquor heaters which maintain correct digester process conditions and often have to be cleaned every 2–4 weeks. This may not interrupt production, but can lead to higher steam consumption to maintain correct process temperatures.

Scale formation can also occur on the liquor separator screens, and this leads to a restriction of liquor flow which reduces plant production and eventually necessitates plant shutdown for cleaning.

We have now found that the calcium carbonate scale deposition during wood pulp production, i.e. in the digester, can be inhibited by using a copolymer of maleic anhydride with certain mono-ethylenically unsaturated monomers or mixtures of monomers such that blockages are significantly reduced and plant efficiency is significantly increased.

Accordingly the present invention provides a process for inhibiting the formation of calcium carbonate scale in wood pulp production which comprises adding to the pulp liquor 1–100 ppm of a hydrolysed copolymer of maleic anhydride with a mono-ethylenically unsaturated monomer or a mixture of monomers, provided that the copolymer is other than a maleic acid/(meth)acrylic acid copolymer. The effective copolymer is thus a hydrolysed copolymer of (A) maleic anhydride with (B) at least one mono-ethylenically unsaturated monomer other than acrylic or methacrylic acid or with a mixture of (B) and (C) acrylic acid or methacrylic acid.

The copolymer may be produced from the monomers in a molar ratio of maleic anhydride to other monomers of from 100:1 to 1:100. Within these limits the ratio may vary according to the water-solubility of the polymer units derived from the other monomers, the ratio generally increasing with decreasing solubility of units derived from the other monomers. Preferably the copolymer has a molar ratio of maleic anhydride to other monomers of at least 1:1 e.g. from 1:1 to 100:1, preferably 1.3:1 to 30:1 and most preferably 2.5:1 to 7:1. The copolymer preferably has a molecular weight up to 10,000.

The ethylenically unsaturated monomers (B) can be selected from a wide range of compounds, for example, crotonic acid, itaconic acid, aconitic acid, esters of said acids, esters of acrylic or methacrylic acid, particularly ethyl acrylate, methyl methacrylate, acrylonitrile, acrylamide, vinyl acetate, styrene, α-methylstyrene, methyl vinyl ketone, acrolein, ethylene, propylene or mixtures thereof.

When mixtures of monomers are used, the resulting polymer may be e.g. a terpolymer derived from maleic anhydride and two other monomers. Such terpolymers are, for example, those derived from maleic anhydride, with two ethylenically unsaturated monomers selected from acrylic acid, methacrylic acid, crotonic acid, itaconic acid, aconitic acid, ethyl acrylate, methyl methacrylate, other esters of said .acids, acrylonitrile, acrylamide, vinyl acetate, styrene, α-methylstyrene, methyl vinyl ketone, acrolein, ethylene and propylene, the molar ratio of the two monomers to each other preferably being from 1:3 to 3:1, especially 1:2 to 2:1.

Suitable copolymers include copolymers of maleic anhydride with at least one monoethylenically unsaturated acid or an ester, amide or water-soluble salt thereof and, optionally, with at least one mono-ethylenically unsaturated hydrocarbon. Preferred such copolymers include copolymers of maleic anhydride with an allylic acid or ester, especially allylsulfonic acid; copolymers of maleic anhydride with an acrylic amide and, optionally, a vinyl carboxylate, especially copolymers of maleic anhydride with N,N-dimethylacrylamide and copolymers of maleic anhydride, the sodium salt of acrylamidomethylpropane sulphonic acid and vinyl acetate; and copolymers of maleic anhydride with an ester of a mono-ethylenically unsaturated acid and either a mono-ethylenically unsaturated acid or a mono-ethylenically unsaturated hydrocarbon, especially terpolymers of maleic anhydride with an alkyl acrylate or alkyl methacrylate and acrylic acid, methacrylic acid or an aliphatic olefine such as ethylene, propylene, hexenes, octenes and decenes.

Another preferred embodiment of the instant invention uses a hydrolyzed terpolymer of maleic anhydride either with (i) vinyl acetate and another ethylenically unsaturated monomer selected from the group consisting of ethyl acrylate, acrylamide methyl vinyl ketone, acrylonitrile and crotonic acid, wherein the molar ratio of vinyl acetate to the other monomer is 1:2 to 2:1, or with (ii) a 1:1 molar ratio of methyl methacrylate and ethyl acrylate; or of methyl acrylate and acrolein.

In an especially preferred embodiment of the instant invention there is used a hydrolyzed terpolymer of maleic anhydride with vinyl acetate and ethyl acrylate, the molar ratio of maleic anhydride to the combined moles of vinyl acetate and ethyl acrylate preferably being from 2.5:1 to 5:1, the molar ratio of vinyl acetate to ethyl acrylate preferably being 1:3 to 3:1, especially 1:2 to 2:1, and the molecular weight of the terpolymer preferably being in the range below 1000.

The copolymer may be made in known manner e.g. by polymerisation in a solvent, especially a reactive solvent using a free-radical initiator such as benzoyl peroxide, di-tertiary butyl peroxide or monobutyl hydroperoxide. Such polymerisation is described in more detail in GB 1414918. The polymer is then hydrolysed using water, dilute acid or alkali.

The copolymer is preferably added to the recycle liquor flow obtained from the recovery process described above (i.e. the white liquor) and recycled to the digester.

The copolymers may also be used in combination with other known scale inhibiting and dispersing agents which are stable under the conditions prevailing in the digestion process. Such compounds may include phosphonates, e.g. hydroxyethane diphosphonic acid (HEDP), amino Iris(methylene phosphonic acid) (AMP), 2-phosphono butane- 1,2,4-tricarboxylic acid, polyacrylic acid, substituted polyacrylic acids and copolymers of acrylic acid.

The invention is illustrated by the following Examples, in which parts and percentages are by weight unless stated otherwise.

Copolymers used in the Examples are prepared as follows.

Polymer I: (a 6:1:1 molar ratio terpolymer of maleic anhydride, vinyl acetate and ethyl acrylate). 294 parts by weight of maleic anhydride dissolved in 300 parts by weight of xylene are heated to reflux temperature with stirring. A solution comprising 43 parts by weight of vinyl acetate, 50 parts by weight of ethyl acrylate, 5 parts by weight of ditertiary butyl peroxide, and 150 parts by weight of xylene is maintained at 20° C. and added over a 2 hour period to the refluxing maleic anhydride solution. Stirring and refluxing are continued for a further 4 hours. The temperature is reduced to 120° C. and the lower resin layer transferred to a separate vessel containing water at 80° C. The resin and water are stirred and residual xylene removed by distillation. During this part of the process the resin dissolves. After boiling with water the solids content is adjusted to 50% w/w. Yield of 50% solution =798 parts by weight.

Polymer II: This is a commercially available 1:1 molar ratio hydrolysed copolymer of maleic anhydride and allyl sulfonic acid.

Polymer III: Maleic anhydride (49 g, 0.5 mol) and dimethylacrylamide (49.5 g, 0.5 mol) are added to xylene (116 g) and the mixture is heated with stirring to reflux temperature. Di-tert.butyl peroxide (1.97 g) is added, with stirring, over 3 hours and stirring and refluxing are then continued for a further 2 hours. The mixture is cooled to 90° C., water (100 ml) is added to give a homogeneous solution and the solution is heated under reflux for 90 minutes. The resulting mixture is cooled to ambient temperature, xylene is separated and the residual aqueous solution is evaporated to dryness. The dry solid obtained is redissolved in water to give 193 g of a 52.1% solution of the hydrolysed copolymer.

Polymer IV: A solution of sodium hydroxide (12 g) in water (170 ml) is added, with cooling, to maleic anhydride (29.4 g, 0.3 mol) to give a monosodium salt. The resulting solution is heated to reflux temperature and 3 further reactants —1 ) acrylamidomethylpropane sulfonic acid sodium salt (22.9 g, 0.1 mol) in water (17 g), 2) vinyl acetate (8.6 g, 0.1 mol), and 3) hydrogen peroxide (14.6 g) and sodium persulfate (2.78 g)-are added separately over 2 hours to the refluxing solution. When addition is complete, the mixture is heated under reflux for a further 3 hours, cooled to ambient temperature and filtered to leave, as the filtrate, Polymer IV as a 17.4% solution.

Polymer V: (a 4:2:1 molar ratio terpolymer of maleic anhydride, acrylic acid and ethyl acrylate). Maleic anhydride (39.2 parts) is added to xylene (100 parts) and the mixture is heated to reflux temperature under nitrogen. A mixture of acrylic acid (14.4 parts) and ethyl acrylate (10 parts) and, separately, a solution of di-tert-.butyl peroxide (2 parts) in xylene (16 parts) are added to the refluxing mixture over a period of 2 hours. When addition is complete, the mixture is heated under reflux for a further 2 hours. The resulting mixture is cooled to 90° C. and water is added. Steam distillation of the resulting mixture gives an aqueous solution of the hydrolysed terpolymer which is evaporated to give Polymer V as a dry solid.

Polymer VI: This is a 1:1 mola ratio copolymer of maleic anhydride and styrene having a number average molecular weight of 1600, available from Aldrich (Catalogue No. 20,060-3), hydrolysed by boiling in water.

Polymer VII: (a 5:1:1 molar ratio terpolymer of maleic anhydride, ethyl ,acrylate and decene). Maleic anhydride (49 parts) is dissolved in xylene (100 parts) and the solution is heated to reflux temperature under nitrogen. A mixture of ethyl acrylate (10 parts) and decene (14.2 parts) and, separately, a solution of di-tert.-butyl peroxide (2.5 parts) in xylene (16 parts) are added to the refluxing mixture over a period of 2 hours. When addition is complete, the mixture is heated under reflux for a further 2 hours. Xylene is removed from the resulting mixture by distillation under vacuum and the molten polymer is cast onto aluminium foil. After solidifying on cooling, the polymer is broken up and hydrolysed in water.

Examples 1–19: The performance of Polymers I to VII is demonstrated in a laboratory test designed to simulate the conditions present in pulp digestion.

This test utilises a solution containing:

8% NaOH 1.9% $Na_2CO_3$ 0.5 KOH

This solution is similar to a white liquor without sodium sulphide. Sodium sulphide is excluded to simplify handling procedures, since it had been shown not to affect the precipitation of calcium carbonate or the performance of additives.

Inhibition of calcium carbonate precipitation 50 mg/L of calcium (as $Ca^{2+}$) is added as calcium chloride to the standard solution along with 10, 20 or 30 mg/L (solids) of the copolymer under test. This solution is stored at 95° C. in stainless steel beakers for 2 hours. After this period the $Ca^{2+}$ remaining in solution is analysed, and the amounts in mg/L are given in the Table:

| Ex. | Polymer | Amount of Polymer (ppm) | $Ca^{2+}$ in Soln (mg/l) |
|---|---|---|---|
| — | — | — | 15 |

-continued

| Ex. | Polymer | Amount of Polymer (ppm) | $Ca^{2+}$ in Soln (mg/l) |
|---|---|---|---|
| 1 | I | 10 | 28 |
| 2 | I | 20 | 44 |
| 3 | I | 30 | 50 |
| 4 | II | 10 | 21 |
| 5 | II | 20 | 22.5 |
| 6 | II | 30 | 28 |
| 7 | III | 20 | 32 |
| 8 | III | 30 | 41 |
| 9 | IV | 20 | 41 |
| 10 | IV | 30 | 41 |
| 11 | V | 10 | 30 |
| 12 | V | 20 | 40 |
| 13 | V | 30 | 50 |
| 14 | VI | 10 | 19.5 |
| 15 | VI | 20 | 25 |
| 16 | VI | 30 | 41.5 |
| 17 | VII | 10 | 21 |
| 18 | VII | 20 | 29 |
| 19 | VII | 30 | 46 |

Example 20: A Kamyr digestion plant is used to make wood pulp for two 4 month periods. In one period no additive is used and in the other Polymer I is added to the recirculated liquor at a rate of 20 ppm.

During the period when no additive is used, the black liquor extraction rate shows a continuous decline and averages 87 $m^3$/hr. The ratio of black liquor extraction to production shows a similar trend and an average of 0.21 $m^3$/hr/t. The decrease in these two parameters is due to blockages of the black liquor extraction screens, reducing the flow of liquor.

When Polymer I is being used, the black liquor extraction rate does not start to decline for 2.5 months and over the period has an average value of 110 $m^3$/hr. The ratio of black liquor extraction to production similarly stays constant and gives an average value of 0.26 $m^3$/hr/t.

The improvement in these two parameters is due to the reduction in calcium carbonate deposition on the liquor extraction screens. Due to the improvement in black liquor removal because of the overall reduction in calcium carbonate deposition, the average production of the plant is 423 t/day compared to 414 t/day when no scale control treatment is used; an overall improvement of 2%.

The cooking liquor recirculation rate without any treatment decreases after about 1 month and the heater is taken out of service after 2 months. This results in some improvement in recirculation rate for about 10 days when the rate again continues to decrease, as a result of calcium carbonate deposition. This indicates that the major problem in maintaining flow rate is not fouling of the heater but blockage of the screens.

During these two periods of operation the recirculation rate averages 154 and 141 $m^3$/hr respectively. When Polymer I is used, the recirculation rate stays reasonably constant for 3 months, no change is made to the heater and the recirculation rate averages 166 $m^3$/hr.

This clearly shows the beneficial effect of Polymer I in reducing blockage of the liquor recirculation screens and reducing the cleaning schedule of the plant.

What is claimed is:

1. An improved process for inhibiting the formation of calcium carbonate scale in wood pulp production wherein the improvement comprises.

adding to a white liquor used to extract lignin from wood 1–100 ppm of a hydrolysed copolymer of (A) maleic anhydride with (B) at least one mono-ethylenically unsaturated monomer other than acrylic acid or methacrylic acid, or with a mixture of (B) and (C) acrylic acid or methacrylic acid.

2. A process as claimed in claim 1, in which the molar ratio of maleic anhydride to other monomer(s) is from 1:100 to 100:1.

3. A process as claimed in claim 2, in which the molar ratio is at least 1:1.

4. A process as claimed in claim 2, in which the molar ratio is from 1:3 to 30:1.

5. A process as claimed in claim 4, in which the molar ratio is from 2.5:1 to 7:1.

6. A process as claimed in claim 1, in which the ethylenically unsaturated monomer (B) is selected from crotonic acid, itaconic acid, aconitic acid, esters of said acids, esters of acrylic acid or methacrylic acid, acrylonitrile, acrylamide, vinyl acetate, styrene, α-methyl styrene, methyl vinyl ketone, acrolein, ethylene, propylene or mixtures thereof.

7. A process as claimed in claim 1, in which the copolymer is a terpolymer derived from maleic anhydride and two other monomers.

8. A process as claimed in claim 1, in which the copolymer is a copolymer of maleic anhydride with at least one mono-ethylenically unsaturated acid, or an ester, amide or water-soluble salt thereof; or a copolymer of maleic anhydride with at least one mono-ethylenically unsaturated acid, or an ester, amide or water-soluble salt thereof, and at least one mono-ethylenically unsaturated hydrocarbon.

9. A process according to claim 8, in which the copolymer is a copolymer of maleic anhydride with an allylic acid or allylic ester; a copolymer of maleic anhydride with an acrylic amide; a copolymer of maleic anhydride with an acrylic amide and a vinyl carboxylate; or a copolymer of maleic anhydride with an ester of a mono-ethylenically unsaturated acid and either a mono-ethylenically unsaturated acid or a mono-ethylenically unsaturated hydrocarbon.

10. A process according to claim 9, in which the copolymer is a copolymer of maleic anhydride with allylsulfonic acid; a copolymer of maleic anhydride with N,N-dimethylacrylamide; a copolymer of maleic anhydride, the sodium salt of acrylamidomethylpropane sulfonic acid and vinyl acetate; or a copolymer of maleic anhydride with (i) an alkyl acrylate or alkyl methacrylate and (ii) acrylic acid, methacrylic acid or an aliphatic olefin.

11. A process as claimed in claim 1, in which the copolymer is a terpolymer derived from maleic anhydride and two ethylenically unsaturated monomers selected from acrylic acid, methacrylic acid, crotonic acid, itaconic acid, aconitic acid, esters of said acids, acrylonitrile, acrylamide, vinyl acetate, styrene, α-methyl styrene, methyl vinyl ketone, acrolein, ethylene and propylene.

12. A process as claimed in claim 11, in which the molar ratio of said two monomers to each other is from 1:3 to 3:1.

13. A process as claimed in claim 12, in which the ratio is from 1:2 to 2:1.

14. A process as claimed in claim 11, in which the terpolymer is a terpolymer of maleic anhydride, ethyl acrylate and vinyl acetate.

15. A process as claimed in claim 14, in which the molar ratio of maleic anhydride to combined vinyl acetate and ethyl acrylate is from 2.5:1 to 5:1.

16. A process as claimed in claim 14, in which the molar ratio of vinyl acetate to ethyl acrylate is from 1:3 to 3:1.

17. A process as claimed in claim 16, in which the ratio is from 1:2 to 2:1.

18. A process as claimed in claim 14, in which the molecular weight of terpolymer is up to 1000.

19. A process as claimed in claim 1, in which the copolymer is added to recycled white liquor.

20. A process as in claim 1 wherein the pH of the white liquor is between 12 and 14.

21. A process as in claim 1 wherein the temperature of the white liquor is between 150° C. and 175° C.

22. A process as in claim 1 wherein the pH of the white liquor is between 12 and 14, and the temperature of the white liquor is between 150° C. and 175° C.

23. A process as in claim 22 wherein the white liquor is recycled white liquor.

* * * * *